US006709224B2

(12) United States Patent
Heiple

(10) Patent No.: US 6,709,224 B2
(45) Date of Patent: Mar. 23, 2004

(54) IMPLEMENT COUPLING ASSEMBLY

(75) Inventor: Ashley Heiple, Alum Bank, PA (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 10/166,631

(22) Filed: Jun. 12, 2002

(65) Prior Publication Data

US 2003/0231946 A1 Dec. 18, 2003

(51) Int. Cl.[7] ..... E02F 3/28
(52) U.S. Cl. ..... 414/723; 37/468
(58) Field of Search ..... 414/723; 37/468; 403/326

(56) References Cited

U.S. PATENT DOCUMENTS 2,963,183 A * 12/1960 Przybylski ..... 414/723
5,224,816 A * 7/1993 Kaczmarczyk et al. ..... 414/723

* cited by examiner

*Primary Examiner*—Donald W. Underwood
(74) *Attorney, Agent, or Firm*—Stevens, Davis, Miller & Mosher, LLP

(57) ABSTRACT

An assembly for detachably coupling an implement to a machine having lift arms and a link cylinder generally consisting of a first component mounted on the implement and having a downwardly opening hook and a downwardly spaced spring biased latch element, and a second component including means for mounting the second component on the lift arms and tilt link of the machine, a connecting pin engageable with the hook on the first component allowing the first component to swing relative to the second component about an axis, a striker element engageable with the latch element in tripping relation when the connecting pin of the second component engages the hook of the first component and the first component is caused to swing toward the second component about the pivotal axis thereof, to position the striker between the latch element and a portion of the first component, and means for selectively depressing the latch element to permit the first component to swing away from the second component.

15 Claims, 2 Drawing Sheets

IMPLEMENT COUPLING ASSEMBLY

This invention relates to a coupling assembly and more particularly to an assembly for detachably connecting an implement such as a bucket, blade, grapple, rake and the like to the operating arms of a machine such as a front end loader.

BACKGROUND OF THE INVENTION

In the use of machines such as front end loaders to perform various work functions such as digging, grading, loading, raking and the like, it has been a common practice to use different types of implements attachable to such loaders for performing such functions. More recently, it has become the conventional practice to utilize various implement designs to permit the rapid coupling and uncoupling of different types of implements in order to improve productivity. In the prior art, there has been developed a great number of such coupling assemblies intended to minimize the amount of time required to uncouple an implement designed to perform a certain work function and couple another implement designed to perform a different function operation. Such a prior art assemblies, however, have not been found to be entirely simple in design, capable of rapidly coupling and uncoupling different implements and effective in performance. Accordingly, it is the principal object of the present invention to provide an improved implement coupling assembly which is simple in design, adapted to be easily and rapidly coupled to and uncoupled from a front end loader, and effective and reliable in performance.

SUMMARY OF THE INVENTION

The present invention provides an improved assembly for coupling an implement to a machine such as to the lift arms and tilt link of a front end loader, generally consisting of a first component attached to an implement including a downwardly opening hook at an upper end thereof, at least one spring seated latch at a lower end thereof, and a cooperating second component including means disposed at a lower end thereof for pivotally connecting the second component to the lifting arms of the loader, means disposed at an upper end thereof for pivotally connecting the second component to the tilt link of the rotor, a connecting pin disposed at a upper, forward portion thereof engageable with the hook member of the first component to permit the first component to be pivotally connected to the second component, a striker element disposed at the lower end thereof adapted to trip the spring seated latch on the first component when the first component is pivotally connected to the upper connecting pin of the second component and the first component is swung towards the second component to position such striker element between such latch element and the first component and thus correspondingly, attach the first component along with such implement to the second component, and means for selectively depressing the latch element and thus permit the first component to be swung away and detached from the second component. Preferably, a pair of transversely spaced, spring seated latches are used, each having an angled surface engageable by a pair of striker elements, to facilitate the tripping of such latches, and a transversely disposed bar is used to depress the latches in detaching the first component from the second component, which is displaced either by a electrically operated solenoid assembly or a fluid actuated cylinder assembly.

DETAILED DESCRIPTION OF AN EMBODIMENT OF THE INVENTION

Figure 4:
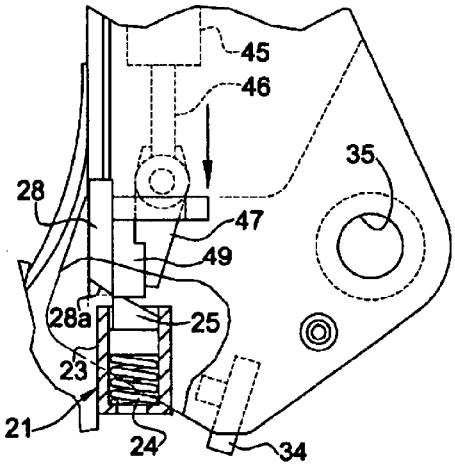
FIG. 4 is a partial view of the view shown in FIG. 2, having a portion thereof broken away and illustrating the method of unlatching the components of the assembly.
Figure 5:
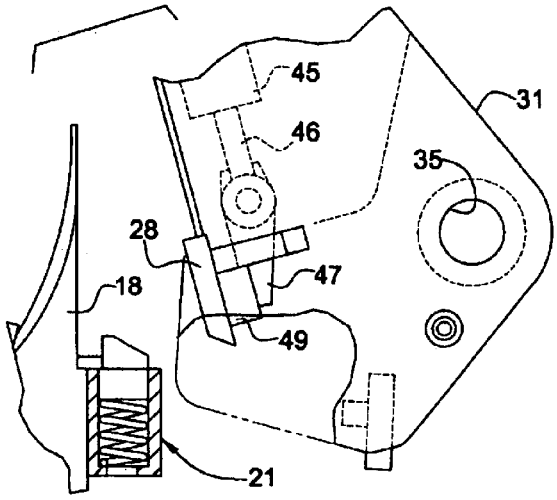
FIG. 5 is a view similar to the view shown in FIG. 5, illustrating the assembly in the unlatched condition.

Referring to the drawings, there is illustrated a coupling assembly 10 including a first component 11 adapted to be rigidly secured to the rear wall 12 of an implement 13, and a cooperating component 14 adapted to be detachably connected to the lift arms and the tilt link of a front end loader. Component 11 includes a transversely disposed, upper plate segment 15, a pair of transversely spaced, lower plate segments 16 and 17 and a pair of transversely spaced plate segments 18 and 19 each interconnecting upper plate segment 15 and a lower segment 16 or 17, all of which are rigidly secured to rear wall 12 of the implement, preferably by welding. Mounted on the underside of upper plate segment 15 is a downwardly opening hook member 20. Mounted on the lower ends of plate segments 18 and 19 is a set of latch devices 21 and 22. As best shown in FIGS. 4 and 5, latch device 21 includes an upperwardly opening cup-shaped receptacle 23, a spring 24 seated therein and a latch element 25 disposed therein and seated on spring 24. Latch device 22 is similar to latch device 21 and includes a latch element 26. Latch elements 25 and 26 are provided with engagement surfaces 25*a* and 26*b*, respectively, which are disposed equidistantly from upper plate segment 15, and lie in a common plane disposed at a angle relative to the lines of travel of such elements in being depressed against the biasing action of the springs on which they are seated.

Component 14 includes a frame consisting of an upper, transversely disposed member 27, a lower transversely disposed member 28, sets of transversely spaced brackets 29 and 30 interconnecting upper and lower members 27 and 28 and a bracket set 131 interconnecting upper and lower members 27 and 28 and disposed intermediate bracket sets 29 and 30. Bracket set 29 includes a pair of transversely spaced plate members 31 and 32 interconnected by means of a pair of spacer members 33 and 34 and provided with a pair of connecting pin openings at the lower ends thereof as at 35. Bracket set 30 is transversely aligned with and similar to bracket set 29 and includes a pair of transversely spaced plate members 36 and 37 interconnected by upper and lower spacer members 38 and 39 and having pin connecting openings at their lower ends transversely aligned with the pin connecting openings in bracket set 29.

Bracket set 131 includes a pair of transversely spaced plate members 40 and 41 provided with a transversely disposed connecting pin 42 at an upper end thereof, a spacer member 43 just below connecting pin 42 and a pair of transversely aligned connecting pin openings 44. Mounted on spacer member 43 and depending therefrom is an electrically operated solenoid 45 having an extendable rod member 46 connected at its free end to a set of brackets 47 and 48 rigidly mounted to a transversely disposed, vertically displaceable bar 49.

The lower end of assembly component 14 is adapted to be mounted on the lower, lift arms of a front end loader by means of a set of connecting pins mounted in openings 35 of bracket sets 29 and 30 registered with openings in the lift arms. The upper end of bracket set 31 is adapted to be connected to the tilt link of the front end loader by means of a connecting pin inserted in openings 44 registered with an opening in the tilt link. With the component thus mounted on the front end loader, it will be appreciated that such component may be lifted and lowered by lifting and lowering the lift arms of the loader and may be tilted about the axis of the lower connection thereof with the lift arms by extending and retracting the cylinder assembly connected to the tilt link. Implement 13 further will be seen as being connectable to component 14 by means of manipulating assembly component 14 to cause connecting pin 42 to be received within hook member 20. By causing connecting pin 42 to engage hook member 20 of component 11 mounted on implement 13 as shown in FIG. 1, and retracting the tilt link, it also will be appreciated that component 11 of the assembly and implement 13 will be caused to swing rearwardly into engagement with assembly component 14 into a coupled condition as shown in FIG. 2.

Figure 2:
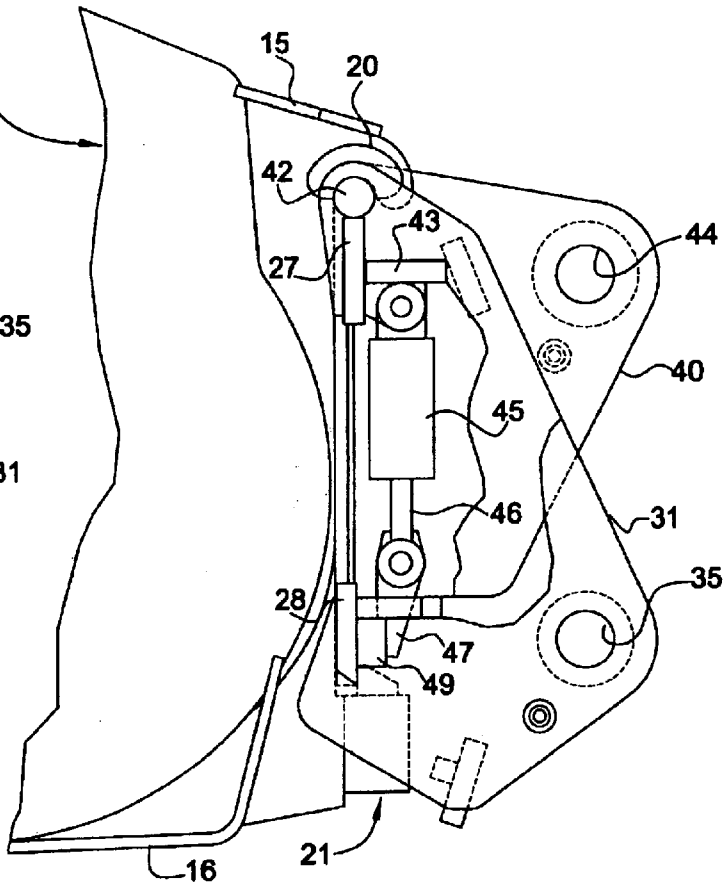
FIG. 2 is a view similar to the view shown in FIG. 1, illustrating the assembly in a fully coupled condition and having portions thereof broken away.
Figure 1:
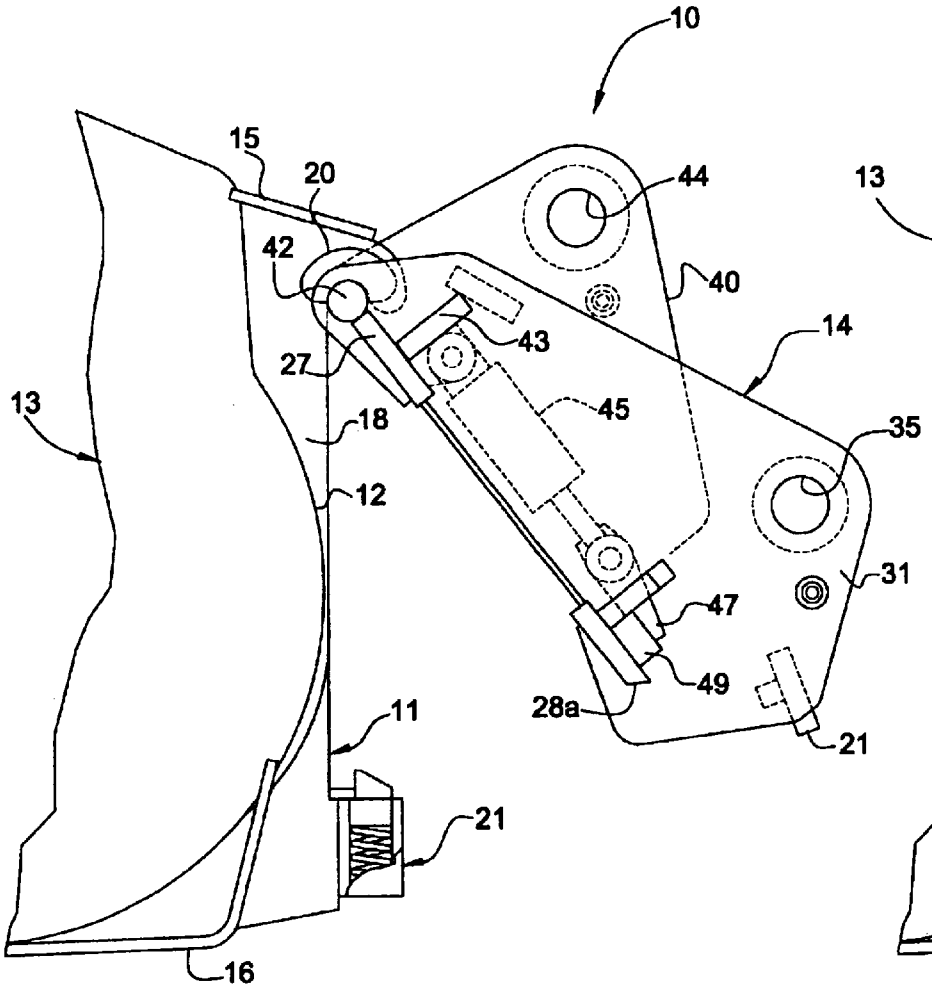
FIG. 1 is a side elevational view of a coupling assembly embodying the present invention, illustrating a first component thereof mounted on an implement and having a portion of such implement broken away, and a second component thereof partially connected to first component.
Figure 3:
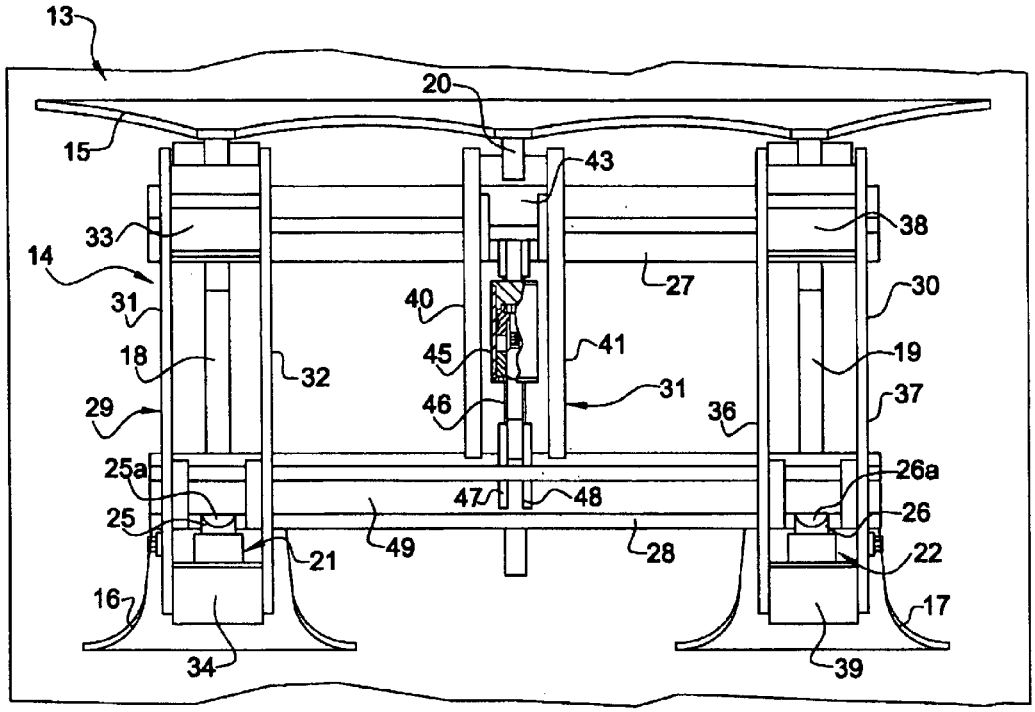
FIG. 3 is a rear elevational view of the assembly in the coupled condition as shown in FIG. 2.

As assembly component 11 with implement 13 is caused to swing rearwardly from the position shown in FIG. 1 to the position shown in FIG. 2, transversely disposed member 28 functioning as a striker will trip latch elements 25 and 26 as it engages such elements and causes them to be depressed against the springs on which they are seated. As such striker member clears the latch elements, it will engage members 18 and 19, and the actions of the springs on which they are seated will cause the latch elements to move upperwardly, securing striker member 28 between plate segments 18 and 19 and latch elements 25 and 26. To facilitate the tripping of latch elements 25 and 26 and cause them to be depressed, striker member 28 is provided with a beveled lower surface 28*a* adapted to engage beveled surfaces 25*a* and 26*a* of the latch elements, as assembly component 11 swings rearwardly from the position shown in FIG. 1 to the position shown in FIG. 2. To depress the latch elements and thus permit striker member 28 to clear the latch elements and component 11 with implement 13 to swing away from component 14, solenoid 45 is energized to extend rod member 46 and cause depressor bar 49 to engage and depress the latch elements.

With assembly component 11 mounted on the rear wall of implement 13, the implement positioned on the ground and assembly component 14 mounted on the lifting arms and the tilt link of the front end loader, the implement may be loaded onto the lift arms of the loader simply by extending the tilt link to lower connecting pin 42 to a level below hook 20, advancing the loader toward the implement so that the connecting pin 42 is positioned below hook 20 and then retracting the tilt link while raising the lift arms to cause connecting pin 42 to engage hook 20 as shown in FIG. 1, and assembly component 11 with implement 13 to swing rearwardly about the axis of connecting pin 42 to the position as shown in FIG. 2. As the implement swings rearwardly towards assembly component 14, portions of beveled surface 28*a* of striker bar 28 will engage surfaces 25*a* and 26*a* of latch element 25 and 26, respectively, to trip such elements and cause the striker bar to engage plate segments 18 and 19, clear of the latch elements. Once the striker bar has cleared the latch elements, the springs on which the latch elements are seated will cause such elements to displace upperwardly, releaseably locking the striker bar between the latch elements and plate segments 18 and 19. When it is desired to uncouple the implement from the loader, solenoid 45 is energized to extend rod member 46 and correspondingly cause retracted bar 49 to engage and depress latch elements 25 and 26 against the biasing action of the springs on which they are seated. With the latch elements thus being cleared from the swing path of striker bar 28, the lift arms and tilt link of the loader may be operated to position connecting pin 41 away from the loader to allow the implement to swing away from assembly component 14, lower the implement to the ground and disengage the connecting pin from hook 20, and thus uncouple the implement from the loader.

Implement 13 may consist of any type of implement including but not limited to a bucket, dozer blade, sheering blade, grapple, rake and the like. The members of the assembly components may be formed of steel plate and bar stock and/or castings suitably connected together, preferably by welding. Although a solenoid is used in the embodiment described for displacing the latch depressing bar, other forms of displacing devices such as fluid actuated cylinder assemblies may be used. A solenoid, however, is preferred in that it utilizes simply an electrical line easily secured to the components of the loader and assembly component t 14 rather than fluid lines which are more expensive, bulkier and prone to damage.

It will be appreciated that the assembly as described is simple in design, comparably inexpensive to manufacture and install and easily operated to rapidly and efficiently couple and uncouple various implements used to perform various work functions to a front end loader.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly for detachably coupling an implement to a machine having lift arms and a tilt link, comprising;

a first component rigidly mountable on said implement having a downwardly opening hook disposed at an upper end thereof and at least one spring biased latch element disposed at a lower end thereof; and a second component including means for mounting said second component on said lift arms for pivotal movement about a first axis, means for connecting said second component to said tilt link for pivotal movement about a second axis, a connecting pin engageable with said hook of said first component allowing said first component to swing relative to said second component about a third axis, a striker engageable with said latch element in tripping relation when said connecting pin of said second component engages said hook of said first component and said first component is caused to swing towards said second component about said third axis, to position said striker between said latch element and a portion of said first component, and means for selectively depressing said latch element to permit said first component to swing away from said second component about said third axis when said connecting pin of said second component engages said hook of said first component.

2. An assembly for detachably coupling an implement to first and second members of a machine, comprising:

a frame;

first means disposed on said frame for detachably connecting said frame to said first machine member for pivotal movement about a first axis;

second means disposed on said frame for detachably connecting said frame to said second machine member for pivotal movement about a second axis;

third means mounted on said frame and cooperative with means mountable on said implements for detachably connecting said implement to said frame for pivotal movement relative thereto about a third axis;

a striker element mounted on said frame;

at least one latch element mounted on said implement, displaceable along a line of travel between extended and retracted positions, biased in said extended position and tripable by said striker element of said frame when said implement is detachably connected to said frame by said third connecting means and is swung toward said frame about the axis of said third connecting means, to position said striker element between said latch element and said implement and correspondingly mount said implement on said frame; and means mounted on said frame for selectively displacing said latch element from said extended position to said retracted position thereof to permit said implement to be swung away from said frame about the axis of said third connecting means.

3. An assembly according to claim 2 wherein each of said first and second connecting means comprises a connecting pin insertable in registered openings in said frame and a machine member.

4. An assembly according to claim 2 wherein said third connecting means comprises a hook mounted on said implement, having an opening facing in the direction of said latch element, and a connecting pin mounted on said frame and receivable in said hook opening.

5. An assembly according to claim 2 wherein said line of travel of said latch element is disposed substantially radially relative to said third axis when said implement is pivotally connected to said frame by means of said third connecting means.

6. An assembly according to claim 2 wherein said latch element is slidably disposed in a recess on such implement and seated on a spring to bias said latching element into its extended position.

7. An assembly according to claim 2 wherein said latch element is provided with a surface engageable by said striker element, lying in a plane disposed at an acute angle relative to said line of travel of said latch element.

8. An assembly according to claim 1 wherein said latch element is provided with a surface engageable with said striker, lying in a plane disposed at an angle relative to a radius of said third axis.

9. An assembly according to claim 2 wherein said displacing means comprises an electrically operated solenoid having an extendable rod member operatively engageable with said latch element for depressing it and thus permitting said striker element to swing and bypass it.

10. An assembly according to claim 2 including a pair of transversely spaced latch elements mountable on said implement, a pair of transversely disposed striker elements mounted on said frame and cooperable with said latch elements, and a pair of transversely disposed members disposed on said frame and selectively engageable with said latch elements for displacing said latch elements from respective extended positions to respective retracted positions to permit said implement to be swung away from said frame about the axis of said third connecting means.

11. An assembly according to claim 10 wherein each of said latch elements is disposed on a bracket mountable on said implement.

12. An assembly according to claim 10 wherein each said striker element is supported on a pair of brackets on said frame.

13. An assembly according to claim 10 wherein said displacing means comprises a solenoid mounted on a pair of brackets of said frame and includes a rod member operatively connecting to said latch element depressing member.

14. An assembly according to claim 10 wherein there is mountable on said implement an upper member having a downwardly opening hook portion and a pair of transversely spaced members, each supporting an latch element.

15. An assembly according to claim 2 wherein said frame includes a pair of transversely spaced set of brackets including means for detachably connecting said frame to said first machine member, a set of brackets disposed between said transversely spaced sets of brackets supporting a pin for connecting said frame to said implement and said displacing means, an upper, transversely disposed member interconnecting said brackets, a lower, transversely disposed member interconnecting said brackets and a lower, displaceable, transversely disposed member operatively connected to said displacing means and engageable with said latch elements when said assembly is in a coupled condition.

* * * * *